US008555799B2

(12) United States Patent
Otsuka et al.

(10) Patent No.: US 8,555,799 B2
(45) Date of Patent: Oct. 15, 2013

(54) PERSONAL WATERCRAFT

(75) Inventors: Kenichi Otsuka, Shizuoka (JP); Michael Knoblett, Newnan, GA (US)

(73) Assignees: Yamaha Hatsudoki Kabushiki Kaisha, Shizuoka (JP); Yamaha Motor Manufacturing Corporation of America, Newnan, GA (US)

( * ) Notice: Subject to any disclaimer, the term of this patent is extended or adjusted under 35 U.S.C. 154(b) by 261 days.

(21) Appl. No.: 13/020,820

(22) Filed: Feb. 4, 2011

(65) Prior Publication Data

US 2012/0199057 A1 Aug. 9, 2012

(51) Int. Cl.
*B63B 17/00* (2006.01)
*B63B 35/81* (2006.01)

(52) U.S. Cl.
USPC ..... 114/55.53; 114/364

(58) Field of Classification Search
USPC ..... 114/55.53, 363, 343, 364; 440/88 N; D12/307
See application file for complete search history.

(56) References Cited

U.S. PATENT DOCUMENTS

| | | | | |
|---|---|---|---|---|
| 5,255,626 | A * | 10/1993 | Hattori et al. | 114/55.53 |
| 5,813,888 | A * | 9/1998 | Ozawa | 440/88 N |
| 6,244,913 | B1 * | 6/2001 | Matsumoto et al. | 440/38 |
| 7,748,334 | B2 * | 7/2010 | Ross et al. | 114/55.57 |
| 2009/0158982 | A1 | 6/2009 | Ross et al. | |

FOREIGN PATENT DOCUMENTS

| | | | |
|---|---|---|---|
| EP | 1759968 | A1 * | 3/2007 |
| JP | 03-088997 | A | 4/1991 |

* cited by examiner

*Primary Examiner* — Lars A Olson
*Assistant Examiner* — Andrew Polay
(74) *Attorney, Agent, or Firm* — Keating & Bennett, LLP

(57) ABSTRACT

A personal watercraft includes a hull, a deck disposed above the hull, and a seat supported on the deck. The deck includes a platform disposed at a stern of the personal watercraft, an outer wall disposed between the seat and the platform, and an inner wall disposed forward relative to the outer wall. The outer wall defines an opening accessible to an article storage space provided between the outer wall and the inner wall. The outer wall includes a lid arranged to open and close the opening.

11 Claims, 12 Drawing Sheets

PERSONAL WATERCRAFT

BACKGROUND OF THE INVENTION

1. Field of the Invention

The present invention relates to a personal watercraft.

2. Description of the Related Art

A conventional personal watercraft is described in Japanese Unexamined Utility Model Application Publication No. H03-088997 (1991). This personal watercraft includes a storage portion provided at the stern, a lid arranged to open and close the storage portion, and a rope to be used when a passenger gets on and off the personal watercraft. The rope is stored in the storage portion.

A conventional personal watercraft is described in U.S. Patent Application Publication No. 2009/0158982 A1. This personal watercraft includes a sub deck and a platform disposed at the stern. The rear portion of the sub deck defines a storage portion. The platform is disposed on the sub deck. The platform is joined to the sub deck so as to be rotatable up and down. The storage portion is opened by the platform.

SUMMARY OF THE INVENTION

The inventors of preferred embodiments of the present invention described and claimed in the present application conducted an extensive study and research regarding a personal watercraft, such as the one described above, and in doing so, discovered and first recognized new unique challenges and previously unrecognized possibilities for improvements as described in greater detail below.

In detail, the personal watercraft preferably includes a large number of article storage portions. For example, in a personal watercraft including a platform, a passenger may sit on the platform in a state in which the personal watercraft is floating in water. Therefore, when the article storage portions are provided at the stern, the passenger can take articles out of and put articles into the storage portions while remaining on the platform.

However, the storage portion provided in the personal watercraft described in Japanese Published Unexamined Utility Model Application No. H03-088997 is for storing rope, and is not for storing articles. Further, in this personal watercraft, no platform is provided, so that it is not disclosed in Japanese Published Unexamined Utility Model Application No. H03-088997 that a passenger on the platform takes articles out of and puts articles into the storage portion.

On the other hand, in the personal watercraft described in U.S. Patent Application Publication No. 2009/0158982 A1, the storage portion is disposed under the platform. Therefore, in a state in which a passenger remains on the platform, the passenger cannot access the storage portion. Therefore, the passenger remaining on the platform cannot take articles out of and put articles into the storage portion.

In order to overcome the previously unrecognized and unsolved challenges described above, a preferred embodiment of the present invention provides a personal watercraft including a hull, a deck disposed above the hull, and a seat supported on the deck. The deck includes a platform disposed at a stern of the personal watercraft, an outer wall disposed between the seat and the platform, and an inner wall disposed forward relative to the outer wall. The platform is disposed along a horizontal plane at a position lower than a rear end of the seat. The outer wall is inclined such that an upper end of the outer wall is positioned forward relative to a lower end of the outer wall. The inner wall is disposed so as to overlap at least a portion of the outer wall from a rearward view. The outer wall defines an opening accessible to an article storage space provided between the outer wall and the inner wall. The outer wall includes a lid arranged to open and close the opening.

With this arrangement of the present preferred embodiment of the present invention, the article storage space is provided between the outer wall and the inner wall. The outer wall is disposed between the seat and the platform. In the outer wall, an opening accessible to the article storage space is provided. Therefore, the opening is disposed at a position that a passenger on the platform can access. The opening is closed by the lid. The lid can open and close the opening. Therefore, a passenger can take articles out of and put articles into the article storage space through the opening while remaining on the platform by opening the lid. Further, the opening is disposed near the rear end of the seat, so that a passenger can take articles out of and put articles into the article storage space through the opening while sitting on the seat. Further, the outer wall is inclined such that the upper end thereof is positioned forward relative to the lower end of the outer wall, so that a passenger sitting on the seat easily accesses the article storage space as compared with the case where, for example, the outer wall extends vertically. Therefore, a passenger can easily access the article storage space from a position on either the deck or the seat.

In another preferred embodiment of the present invention, the deck may further include a hinge which joins the lid and the deck. The lid may be arranged to rotate around the hinge between a closed position at which the lid closes the opening and an opened position at which the lid opens the opening.

In another preferred embodiment of the present invention, the hinge may be provided on a lower portion of the lid.

In another preferred embodiment of the present invention, the hinge may be arranged to be used as a grip which is gripped by a user during movement of the user from a position in water behind the platform to a position on the platform.

In another preferred embodiment of the present invention, the platform and the inner wall may be integral with each other, and the outer wall may be separate from the platform and the inner wall.

In another preferred embodiment of the present invention, a gap communicated with the article storage space may be provided between either the platform or the inner wall and the lower end of the outer wall.

In another preferred embodiment of the present invention, the rear end of the seat may be disposed rearward relative to the upper end of the outer wall.

In another preferred embodiment of the present invention, the personal watercraft may further include a cooling water passage disposed inside the personal watercraft, and a washing water passage arranged to supply water to the cooling water passage so as to wash the cooling water passage. In this case, the washing water passage may include a first end portion connected to the cooling water passage and a second end portion connected to the article storage space. Further, the washing water passage may include a check valve arranged such that water flows in only a direction from the second end portion to the first end portion.

In another preferred embodiment of the present invention, the inner wall may include a rear portion and a pair of right and left side portions connected to the rear portion. In this case, the article storage space may have a U-shaped horizontal sectional shape along the rear portion and the pair of side portions.

Still another preferred embodiment of the present invention provides a personal watercraft including a hull, a deck disposed above the hull, and a seat supported on a seat support portion of the deck. The deck includes a platform disposed at a stern of the personal watercraft, and a cover covering at least a portion of the seat support portion at a height between a rear end of the seat and the platform from the rear side. The platform is disposed along a horizontal plane at a position lower than the rear end of the seat. The deck defines an article storage space provided between the seat support portion and the cover.

With this arrangement of the present preferred embodiment, the article storage space is disposed at a position which a passenger on the platform can access. Therefore, a passenger can take articles out of and put articles into the article storage space while remaining on the platform. Further, the article storage space is disposed near the rear end of the seat, so that a passenger can take articles out of and put articles into the article storage space while sitting on the seat. Therefore, a passenger can easily access the article storage space from a position on either the deck or the seat.

In another preferred embodiment of the present invention, the deck may define an opening accessible to the article storage space.

In another preferred embodiment of the present invention, the deck may include a lid covering the opening. The lid may be arranged to open and close the opening.

In another preferred embodiment of the present invention, the deck may further include a hinge which joins the lid and the deck. The lid may be arranged to rotate around the hinge between a closed position at which the lid closes the opening and an opened position at which the lid opens the opening.

In another preferred embodiment of the present invention, the hinge may be provided on a lower portion of the lid.

In another preferred embodiment of the present invention, the hinge may be arranged to be used as a grip which is gripped by a user during movement of the user from a position in water behind the platform to a position on the platform.

In another preferred embodiment of the present invention, the opening may be provided at a position above the article storage space.

In another preferred embodiment of the present invention, the cover may be arranged to move between a closed position at which the article storage space is closed and an opened position at which the article storage space is opened.

In another preferred embodiment of the present invention, the deck may further include a hinge which joins the cover and the deck. The cover may be arranged to rotate around the hinge between a closed position at which the article storage space is closed and an opened position at which the article storage space is opened.

In another preferred embodiment of the present invention, the seat support portion may include a rear portion and a pair of right and left side portions connected to the rear portion. In this case, the article storage space may have a U-shaped horizontal sectional shape along the rear portion and the pair of side portions.

Still another preferred embodiment of the present invention provides a personal watercraft including a hull, a deck, a jet pump, an engine, a steering handle, and a seat. The deck is disposed above the hull. The deck includes a platform. The platform is disposed along a horizontal plane at a stern of the personal watercraft. The jet pump is disposed at a rear portion of the hull below the platform. The jet pump is arranged to generate a propulsive force by jetting water, suctioned from below the personal watercraft, rearward. The engine is disposed forward relative to the jet pump. The engine is arranged to drive the jet pump. The steering handle is disposed above the deck. The steering handle is arranged to change a jetting direction of water from the jet pump to right and left. The seat is disposed above the engine at a rear of the steering handle. The seat is supported on the deck. The seat includes a rear end disposed higher than the platform. The deck defines an article storage space. The article storage space is disposed rearward relative to the engine. Further, the article storage space is disposed at a height between the rear end of the seat and the platform.

With this arrangement of the present preferred embodiment of the present invention, the article storage space is disposed at a position which a passenger on the platform can access. Therefore, the passenger can take articles out of and put articles into the article storage space while remaining on the platform. Further, the article storage space is disposed near the rear end of the seat, so that the passenger can take articles out of and put articles into the article storage space while sitting on the seat. Therefore, the passenger can easily access the article storage space from a position on either the deck or the seat.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a personal watercraft in a reference posture will be described. The reference posture is a posture in which the personal watercraft floats in static water (water that stands still and does not move). The drawings show a personal watercraft in the reference posture.

First Preferred Embodiment

Figure 1:
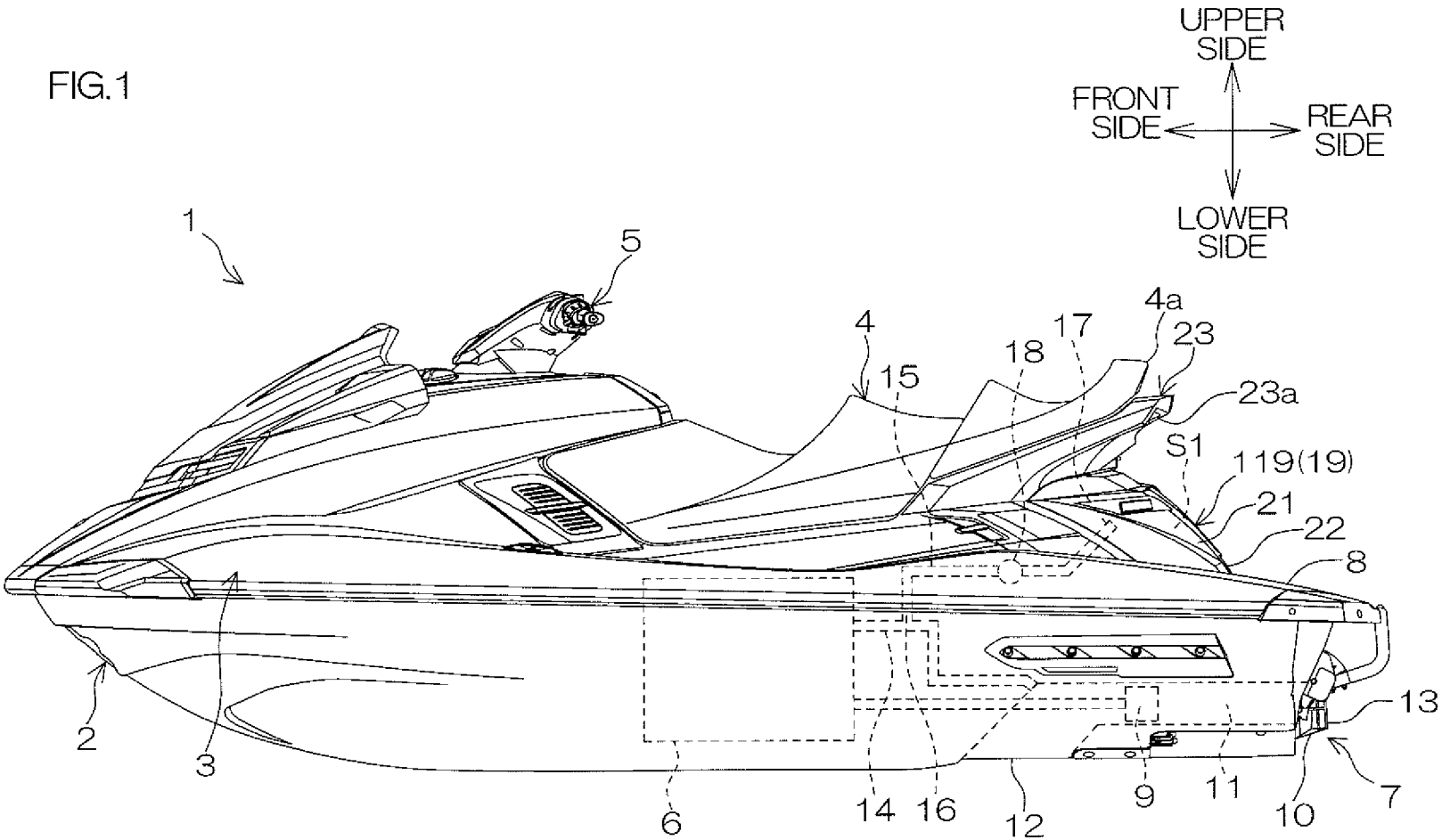
FIG. 1 is a side view of a personal watercraft according to a first preferred embodiment of the present invention.
Figure 2:
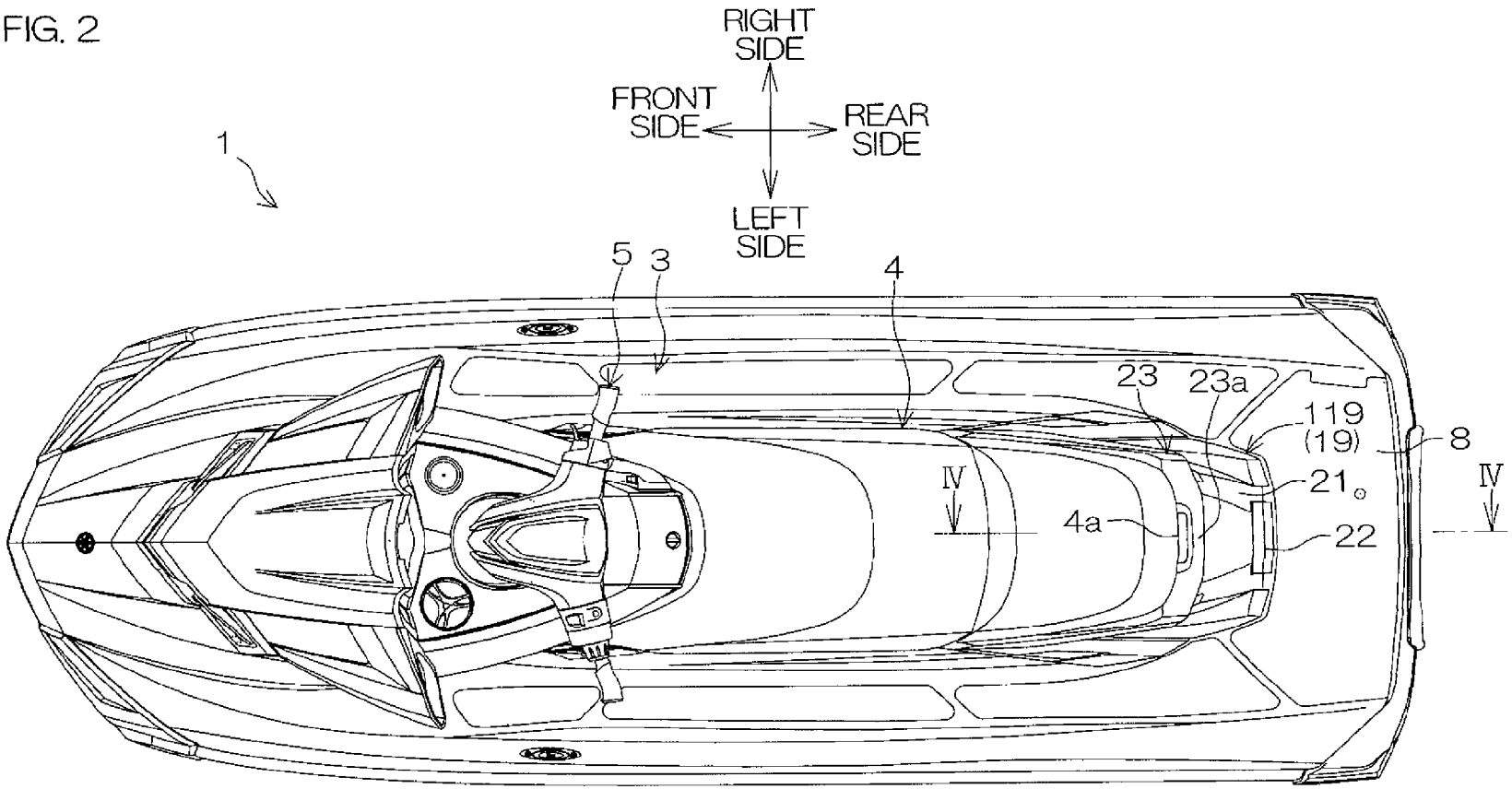
FIG. 2 is a plan view of the personal watercraft according to the first preferred embodiment of the present invention.
Figure 3:
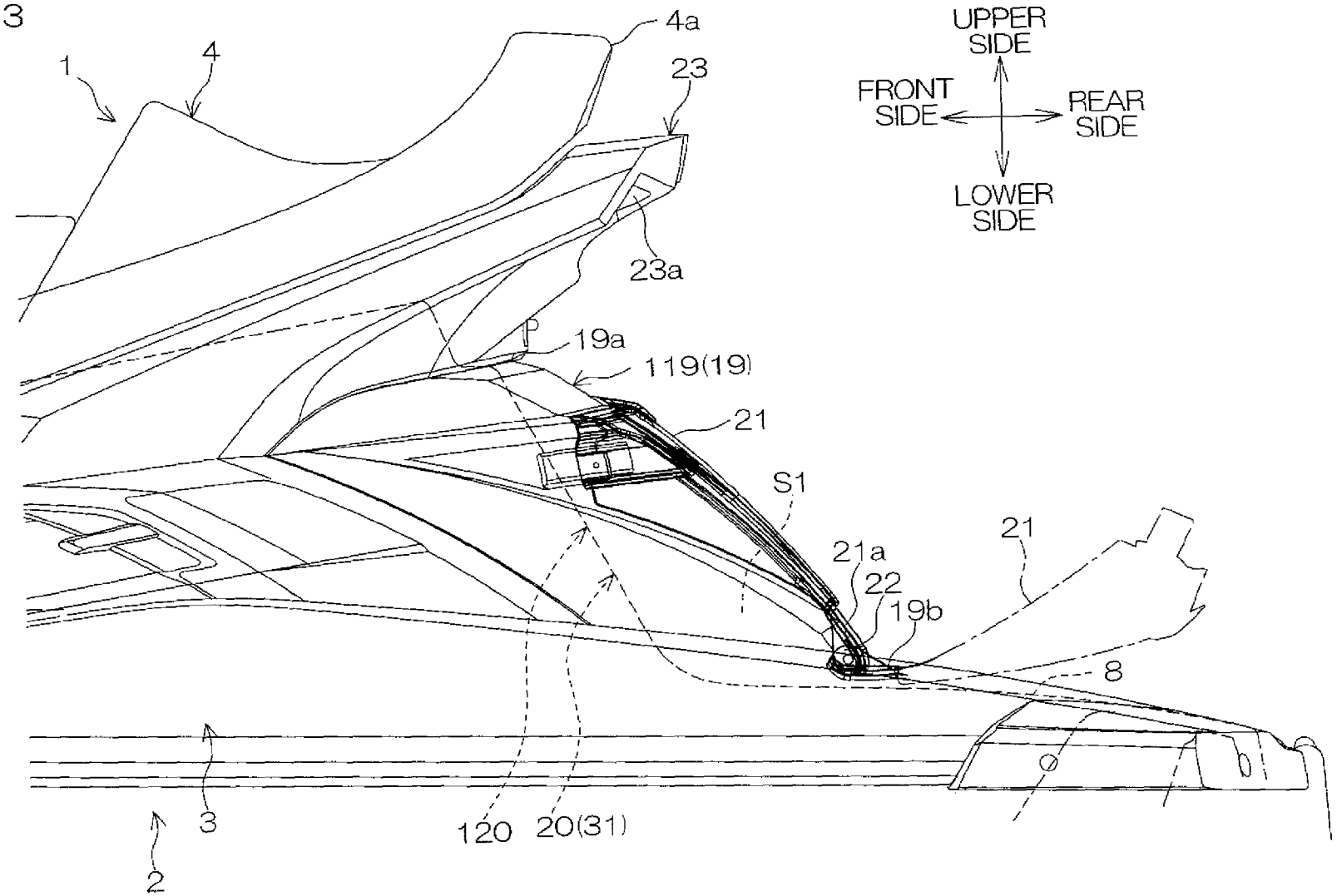
FIG. 3 is a side view of the rear portion of the personal watercraft according to the first preferred embodiment of the present invention.

FIG. 1 is a side view of a personal watercraft 1 according to a first preferred embodiment of the present invention. FIG. 2 is a plan view of the personal watercraft 1 according to the first preferred embodiment of the present invention. FIG. 3 is a side view of a rear portion of the personal watercraft 1 according to the first preferred embodiment of the present invention. In FIG. 3, a state in which a lid 21 that will be described later is at a closed position is shown by a solid line, and a state in which the lid 21 is at an opened position is shown by alternate long and short dashed lines. Hereinafter, FIG. 1 to FIG. 3 are referred to as is appropriate.

As shown in FIG. 1, the personal watercraft 1 includes a hull 2, a deck 3, a seat 4, and a steering handle 5. The deck 3 is disposed above the hull 2. The seat 4 and the steering handle 5 are disposed above the deck 3. The seat 4 and the steering handle 5 are supported on the deck 3. As shown in FIG. 2, the seat 4 and the steering handle 5 are disposed at a central portion of the personal watercraft 1 in the right-left direction. The seat 4 is disposed at the rear of the steering handle 5. The seat 4 extends in the front-rear direction in a plan view. The seat 4 has, for example, a three-seater configuration. The seat 4 is not limited to a three-seater configuration, and may have a two-seater configuration or a single-seater configuration.

As shown in FIG. 1, the personal watercraft 1 further includes an engine 6 and a jet pump 7. The engine 6 is disposed inside the hull 2. The jet pump 7 is disposed at the rear portion of the hull 2. The engine 6 is disposed forward relative to the jet pump 7. The seat 4 is disposed above the engine 6. The deck 3 includes a platform 8 disposed at the stern of the personal watercraft 1. The jet pump 7 is disposed below the platform 8. The jet pump 7 is driven by the engine 6.

As shown in FIG. 3, the platform 8 is disposed along a horizontal plane below the rear end 4*a* of the seat 4. As shown in FIG. 2, the platform 8 preferably has a quadrilateral shape in a plan view. The right and left sides and the rear side of the platform 8 are open. In a state in which the personal watercraft 1 floats in water, the platform 8 is higher than the water surface. Therefore, a passenger can climb down into water from a position on the platform 8 through the lateral side or rear side of the platform 8. Further, a passenger can move from a position in water onto the platform 8 through the lateral side or rear side of the platform 8.

The jet pump 7 is arranged to generate a propulsive force by jetting water suctioned from below rearward. In detail, as shown in FIG. 1, the jet pump 7 includes an impeller 9 joined to the engine 6 and a deflector 10 disposed at the rear of the impeller 9. The impeller 9 is disposed in a flow passage 11 provided inside the personal watercraft 1. A first end portion of the flow passage 11 defines an intake 12 opened at the bottom surface of the hull 2, and a second end portion of the flow passage 11 defines an outlet 13 opened at the deflector 10. The deflector 10 is arranged to turn to the right or left according to an operation of the steering handle 5.

When the impeller 9 is driven to rotate by the engine 6, water is suctioned from the intake 12 into the flow passage 11. Then, water suctioned into the flow passage 11 is jetted from the outlet 13. Accordingly, a propulsive force is generated to propel the personal watercraft 1. When the steering handle 5 is operated, the direction of the deflector 10 changes, and the jetting direction of water from the deflector 10 changes. Therefore, the steering handle 5 is arranged to change the jetting direction of water from the jet pump 7. The personal watercraft 1 is steered by operations of the steering handle 5.

As shown in FIG. 1, the personal watercraft 1 further includes a cooling water passage 14 and a washing water passage 15 disposed inside the personal watercraft 1. The cooling water passage 14 is connected to the engine 6 and the jet pump 7. A portion of water suctioned into the flow passage 11 from the intake 12 by the jet pump 7 is supplied into the cooling water passage 14. Then, water supplied into the cooling water passage 14 is supplied to a water jacket provided in the engine 6. Accordingly, the engine 6 is cooled.

On the other hand, as shown in FIG. 1, the washing water passage 15 includes a first end portion 16 connected to the cooling water passage 14, a second end portion 17 connected to an article storage space S1 that will be described later, and a check valve 18 arranged such that water flows in only a direction from the second end portion 17 to the first end portion 16. Therefore, even if water flows into the washing water passage 15 from the cooling water passage 14, this water is checked by the check valve 18. On the other hand, water supplied into the washing water passage 15 from the second end portion 17 flows into the cooling water passage 14 through the check valve 18. The cooling water passage 14 and the water jacket are washed with water supplied from the washing water passage 15.

Figure 4:
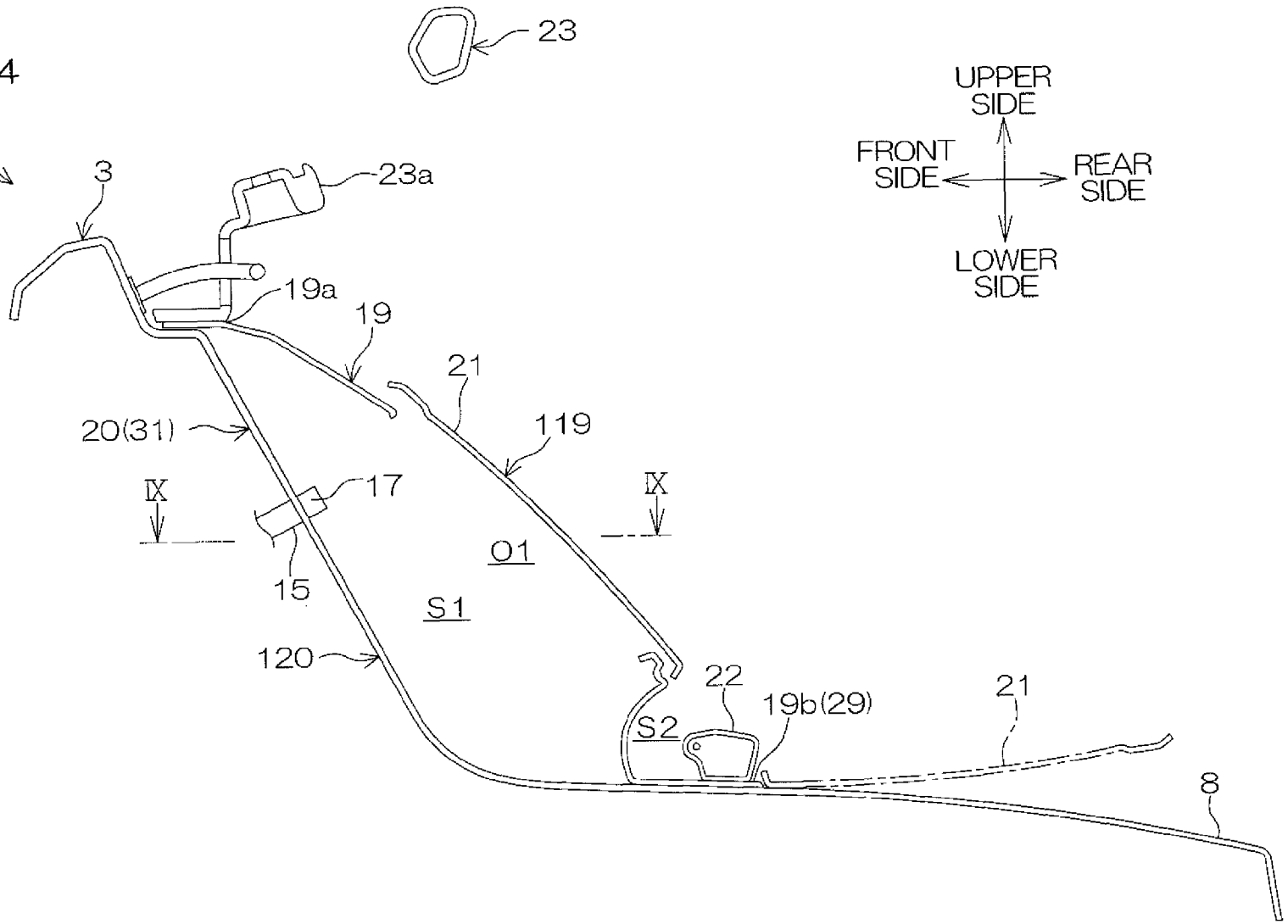
FIG. 4 is a schematic view of the rear portion of the personal watercraft cut along a vertical plane along line IV-IV in FIG. 2.
Figure 5:
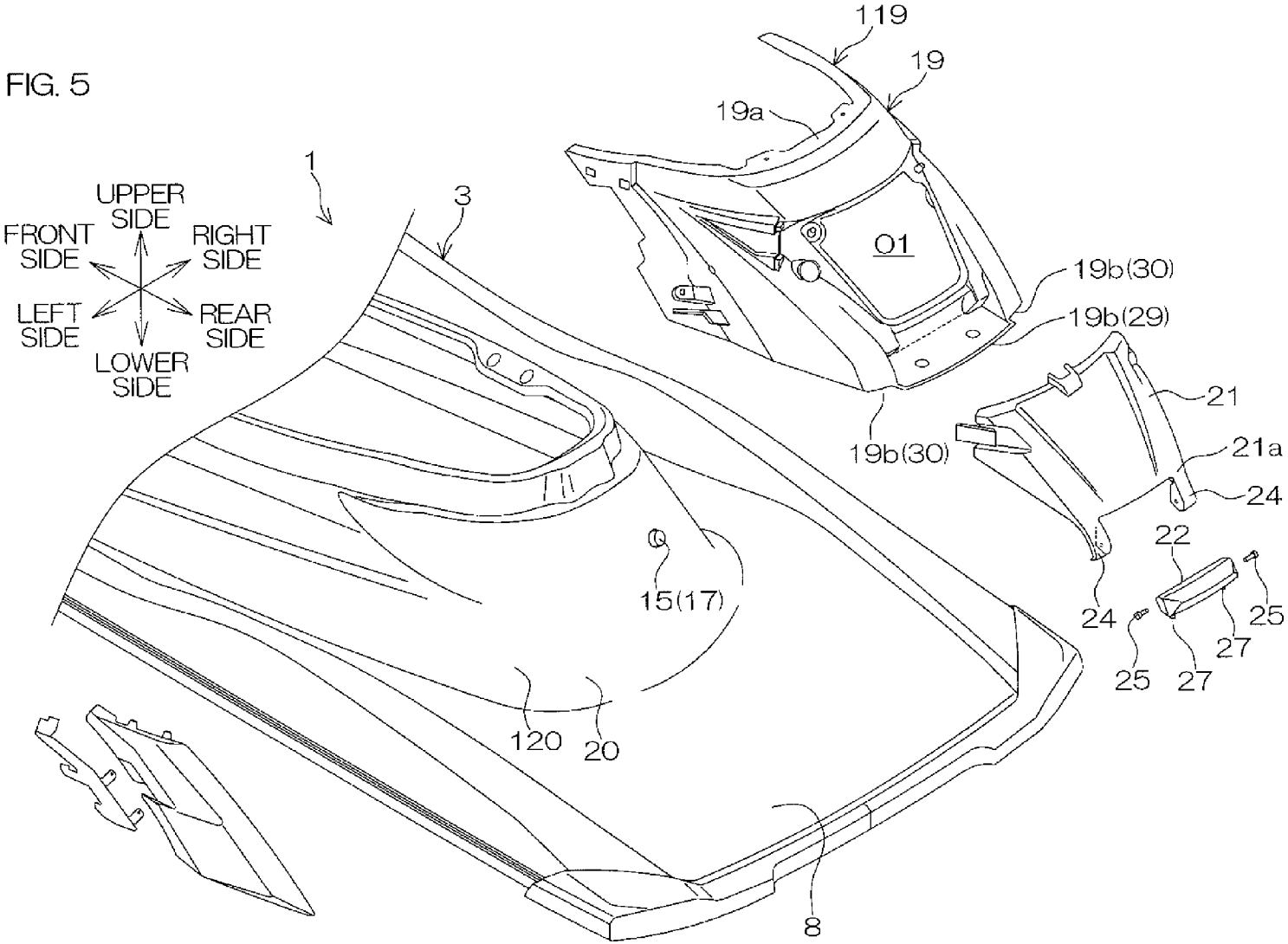
FIG. 5 is an exploded perspective view of a deck and an arrangement relating thereto according to the first preferred embodiment of the present invention.
Figure 6:
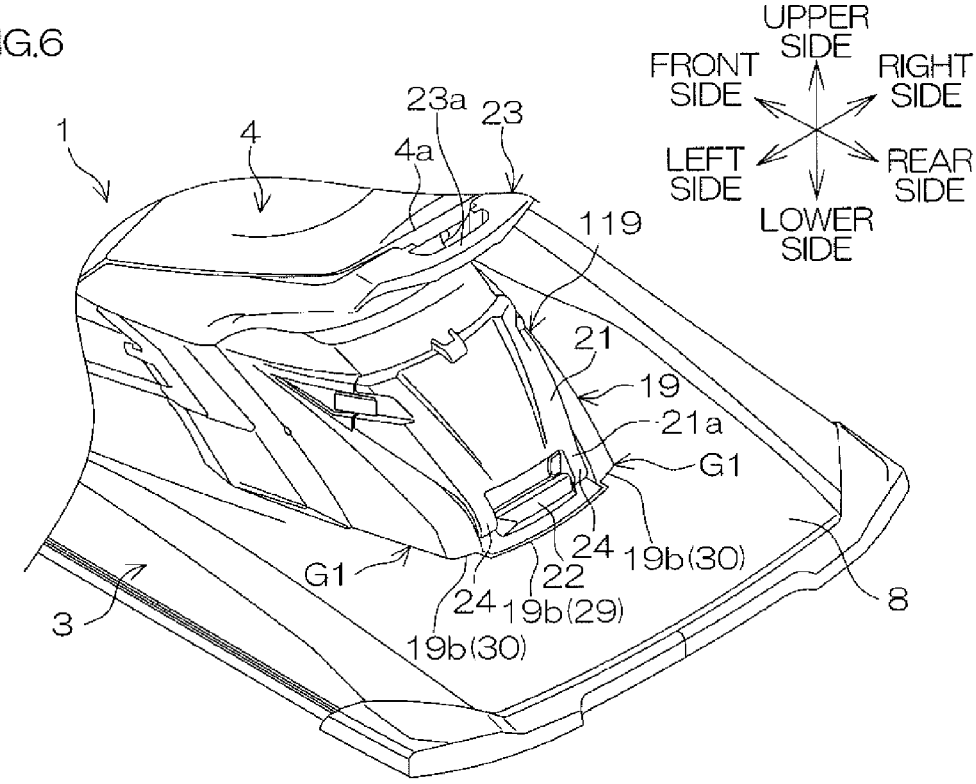
FIG. 6 is a perspective view of the rear portion of the personal watercraft according to the first preferred embodiment of the present invention.
Figure 7:
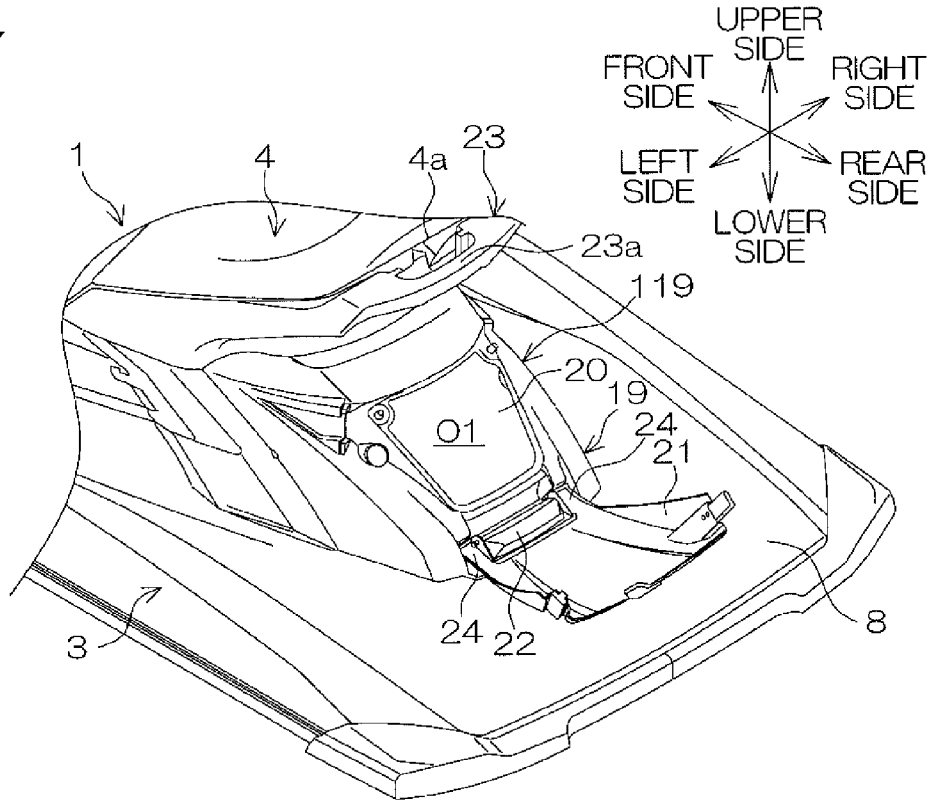
FIG. 7 is a perspective view of the rear portion of the personal watercraft according to the first preferred embodiment of the present invention.

FIG. 4 is a schematic view of a rear portion of the personal watercraft 1 cut along a vertical plane along line IV-IV in FIG. 2. FIG. 5 is an exploded perspective view of a deck 3 and an arrangement relating thereto according to the first preferred embodiment of the present invention. FIG. 6 and FIG. 7 are perspective views of the rear portion of the personal watercraft 1 according to the first preferred embodiment of the present invention.

In FIG. 4, a state in which the lid 21 is at a closed position is shown by a solid line, and a state in which the lid 21 is at an opened position is shown by alternate long and short dashed lines. FIG. 6 shows a state in which the lid 21 is at the closed position, and FIG. 7 shows a state in which the lid 21 is at the opened position. Hereinafter, FIG. 1 to FIG. 7 will be referred to as is appropriate.

As shown in FIG. 3, the deck 3 includes a seat support portion 120 which supports the seat 4, and a cover 119 covering the seat support portion 120 at a height between the rear end 4*a* of the seat 4 and the platform 8 from the rear side. As shown in FIG. 4, the cover 119 includes an outer wall 19, and the seat support portion 120 includes an inner wall 20. The platform 8 and the inner wall 20 preferably are integral with each other, and the outer wall 19 is separate from the platform 8 and the inner wall 20. Specifically, as shown in FIG. 5, the platform 8 and the inner wall 20 are portions of a common member, and the outer wall 19 is a member separate from the common member. The platform 8 and the inner wall 20 are not limited to being integral with each other, and may be separate from each other. As shown in FIG. 3, the outer wall 19 is disposed between the rear end 4*a* of the seat 4 and the platform 8. The outer wall 19 is inclined such that the upper end 19*a* of the outer wall 19 is positioned forward relative to the lower end 19*b* of the outer wall 19. The rear end 4*a* of the seat 4 is disposed rearward relative to the upper end 19*a* of the outer wall 19.

As shown in FIG. 4, the inner wall 20 extends upward from the platform 8. The inner wall 20 is disposed forward relative to the outer wall 19. The inner wall 20 is disposed such that at least a portion of the outer wall 19 and the inner wall 20 overlap each other from a rearward view. The inner wall 20 is inclined such that the upper end of the inner wall 20 is positioned forward relative to the lower end of the inner wall 20. The outer wall 19 and the inner wall 20 define an article storage space S1 between the outer wall 19 and the inner wall 20.

As shown in FIG. 1, the article storage space S1 is disposed rearward relative to the engine 6. The article storage space S1 is disposed at a height between the rear end 4*a* of the seat 4 and the platform 8. The article storage space S1 is disposed forward relative to the rear end of the platform 8. As shown in FIG. 4, the outer wall 19 defines an opening O1 accessible to the article storage space S1. The opening O1 penetrates through the outer wall 19 in the front-rear direction. The opening O1 is disposed at the rear of the article storage space S1. The article storage space S1 is accessible from the rear side through the opening O1.

As shown in FIG. 6 and FIG. 7, the outer wall 19 includes a lid 21 arranged to open and close the opening O1. The deck 3 further includes a hinge 22 which joins the lid 21 and the deck 3. The hinge 22 is provided on the lower portion 21*a* of the lid 21. The lid 21 is rotatable around the hinge 22 between a closed position at which the lid 21 closes the opening O1 and an opened position at which the lid 21 opens the opening O1. The hinge 22 is arranged to function as a grip 22. Specifically, as shown in FIG. 4, the hinge 22 is disposed at the rear of the article storage space S1, and projects upward. The hinge 22 has a bar shape, and extends in the right-left direction. The hinge 22 and the outer wall 19 define a hand insertion space S2 which is positioned between the hinge 22 and the outer wall 19 and accessible from above. A passenger (user) who wants to move to a position on the platform 8 from a position in water behind the platform 8 can easily move onto the platform 8 by inserting his/her hand into the hand insertion space S2 and gripping onto the grip 22.

As shown in FIG. 2, the personal watercraft 1 further includes a mount grip 23 having a U shape in a plan view disposed along the rear portion of the seat 4. The mount grip 23 extends forward along the rear portion of the seat 4 from the rear end 4*a* of the seat 4. The mount grip 23 includes a grip portion 23*a* provided at the rear end portion of the mount grip 23. As shown in FIG. 1, the hinge 22 is disposed rearward relative to the grip portion 23*a* and lower than the grip portion 23*a*. Further, the hinge 22 is disposed lower than the seat 4. The hinge 22 is closer to the platform 8 than the grip portion 23*a*.

Figure 8:
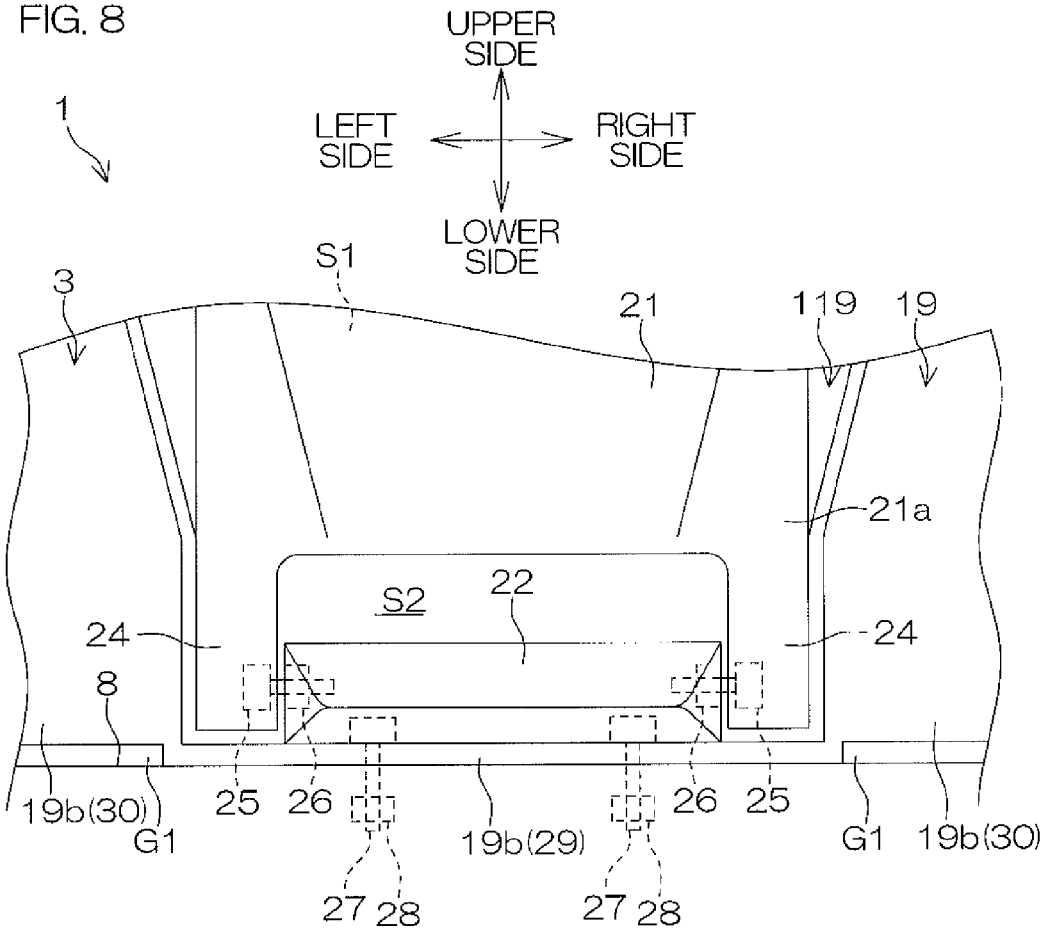
FIG. 8 is a schematic view of a lid and an arrangement relating thereto according to the first preferred embodiment of the present invention from the rear side.

FIG. 8 is a schematic view of the lid 21 and an arrangement relating thereto according to the first preferred embodiment of the present invention from the rear side. Hereinafter, FIG. 6 and FIG. 8 will be referred to as is appropriate.

As shown in FIG. 8, the lid 21 includes a pair of joint portions 24 provided on the lower portion 21*a* of the lid 21. The pair of joint portions 24 are spaced from each other in the right-left direction. The hinge 22 is disposed between the pair of joint portions 24. The hinge 22 is joined to the pair of joint portions 24 by, for example, two pairs of first bolts 25 and first nuts 26. In detail, each first bolt 25 is attached to the joint portion 24 and the hinge 22 from the lateral side, and projects inward from the joint portion 24. Each first nut 26 is disposed inside the hinge 22, and each first bolt 25 is attached to a corresponding first nut 26. The joint portion 24 is rotatable with respect to the first bolt 25. Accordingly, the lid 21 is joined rotatably to the hinge 22.

As shown in FIG. 8, the hinge 22 is joined to the platform 8 together with the outer wall 19 preferably by, for example, two pairs of second bolts 27 and second nuts 28. In detail, the hinge 22 is disposed above the platform 8, and the lower end 19*b* of the outer wall 19 (a contact portion 29 that will be described later) is interposed between the hinge 22 and the platform 8. The second bolts 27 project downward from the hinge 22, and penetrate through the lower end 19*b* of the outer wall 19 and the upper surface of the platform 8 in the up-down direction. Each second nut 28 is attached to a corresponding second bolt 27 below the upper surface of the platform 8. Accordingly, the hinge 22 is joined to the platform 8 together with the outer wall 19.

As shown in FIG. 6, the lower end 19*b* of the outer wall 19 is disposed along the platform 8. The lower end 19*b* of the outer wall 19 includes a contact portion 29 in contact with the platform 8, and non-contact portions 30 not in contact with the platform 8. The non-contact portions 30 are disposed on both right and left sides of the contact portion 29. Each non-contact portion 30 extends laterally from the contact portion 29, and then extends forward. Non-contact portions 30 have L shapes in a plan view. As shown in FIG. 8, a sealing member such as a seal is not disposed between the non-contact portions 30 and the platform 8, and the non-contact portions 30 and the platform 8 are opposed to each other at a distance in the up-down direction. Therefore, non-contact portions 30 and the platform 8 define gaps G1 positioned between the non-contact portions 30 and the platform 8. These gaps G1 are communicated with the article storage space S1.

Figure 9:
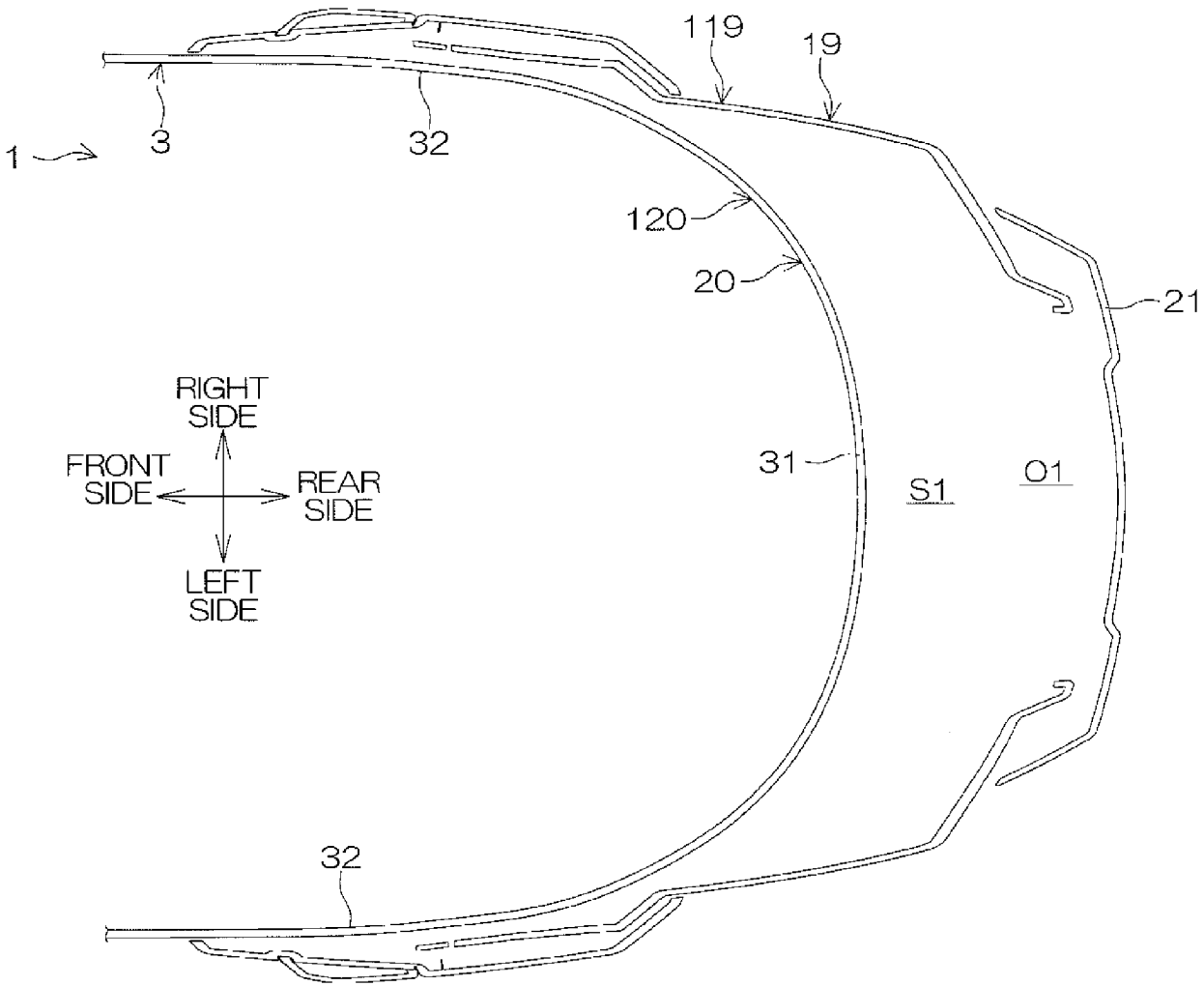
FIG. 9 is a schematic view of the rear portion of the personal watercraft cut along a horizontal plane along line IX-IX in FIG. 4.

FIG. 9 is a schematic view of the rear portion of the personal watercraft 1 cut along a horizontal plane along line IX-IX in FIG. 4. Hereinafter, FIG. 4 and FIG. 9 will be referred to as is appropriate.

As shown in FIG. 9, the inner wall 20 includes a rear portion 31, and a pair of right and left side portions 32 connected to the rear portion 31. The pair of side portions 32 extend forward from the right end portion and the left end portion of the rear portion 31. The inner wall 20 has a U shape in a horizontal cross section. The outer wall 19 covers the rear portion 31 and the pair of side portions 32. Therefore, the article storage space S1 has a U-shaped horizontal sectional shape along the rear portion 31 and the pair of side portions 32. Further, as shown in FIG. 4, an upper portion of the outer wall 19 is superposed on the inner wall 20 from above. The outer wall 19 and the inner wall 20 are inclined at angles different from each other with respect to the horizontal plane. Therefore, the article storage space S1 preferably has a triangular vertical sectional shape.

As described above, in the first preferred embodiment, the article storage space S1 is preferably provided between the outer wall 19 and the inner wall 20. The outer wall 19 is disposed between the seat 4 and the platform 8. The outer wall 19 defines an opening O1 accessible to the article storage space S1. Therefore, the opening O1 is disposed at a position which a passenger on the platform 8 can access. The opening O1 is closed by the lid 21. The lid 21 can open and close the opening O1. Therefore, by opening the lid 21, the passenger can take articles out of and put articles into the article storage space S1 through the opening O1 while remaining on the platform 8. Further, the opening O1 is disposed near the rear end 4*a* of the seat 4, so that the passenger can take articles out of and put articles into the article storage space S1 through the opening O1 while sitting on the seat 4. Further, the outer wall 19 is inclined such that the upper end 19*a* of the outer wall 19 is positioned forward relative to the lower end 19*b* of the outer wall 19, so that the passenger sitting on the seat 4 easily accesses the article storage space S1 as compared with, for example, a case where the outer wall 19 extends vertically. Therefore, the passenger can easily access the article storage space S1 from a position on either the deck 3 or the seat 4.

In the first preferred embodiment, the deck 3 includes the hinge 22 which joins the lid 21 and the deck 3. The hinge 22 is provided on the lower portion 21*a* of the lid 21. The lid 21 turns around the lower portion 21*a* of the lid 21. The rear end 4*a* of the seat 4 and the mount grip 23 are disposed on the obliquely upper side of the lid 21. Therefore, for example, in a case where the lid 21 turns around the upper portion of the lid 21, when the lid 21 is opened wide, the lid 21 comes into contact with the rear end 4*a* of the seat 4 and the mount grip 23. Therefore, the maximum opening angle of the lid 21 is limited by the rear end 4*a* of the seat 4 and the mount grip 23. Therefore, by providing the hinge 22 on the lower portion 21*a* of the lid 21, the maximum opening angle of the lid 21 can be increased. Further, in the case where the hinge 22 is provided on the upper portion of the lid 21, when the lid 21 is opened, the lid 21 is positioned above the opening O1. Therefore, when a passenger takes articles out of and put articles into the article storage space S1, the lid 21 becomes an obstacle. Therefore, as compared with the case where the hinge 22 is provided on the lower portion 21*a* of the lid 21, it is difficult for a passenger to access the article storage space S1. Therefore, by providing the hinge 22 on the lower portion 21*a* of the lid 21, a passenger can easily take articles out of and put articles into the article storage space S1.

In the first preferred embodiment, the hinge 22 is arranged to be used as a grip which is gripped during movement from a position in water behind the platform 8 to a position on the platform 8. Therefore, a passenger who wants to move from a position in water behind the platform 8 to a position on the platform 8 can easily move onto the platform 8 by gripping onto the hinge 22. Further, the hinge 22 is disposed along the lower end 19*b* of the outer wall 19, so that the distance from the rear end of the platform 8 to the hinge 22 is short. Therefore, a passenger who wants to move onto the platform 8 from the rear side can grip the hinge 22 easily and immediately. Therefore, the passenger who wants to move onto the platform 8 from a position in water behind the platform 8 can easily move onto the platform 8 immediately.

Further, in the first preferred embodiment, the gaps G1 communicated with the article storage space S1 are preferably provided between the platform 8 and the lower end 19*b* of the outer wall 19. Therefore, even if water enters the article storage space S1, this water is drained to the outside of the article storage space S1 through the gaps G1. Therefore, for example, even if a wet article is stored in the article storage space S1, retention of water in the article storage space S1 can be reliably prevented. Further, the outer surface of the outer wall 19 and the inner surface of the inner wall 20 are inclined with respect to the horizontal plane, so that water adhering to the outer surface of the outer wall 19 and the inner surface of the inner wall 20 is guided downward by the outer wall 19 and the inner wall 20. Accordingly, water that entered the article storage space S1 can be reliably drained through the gaps G1.

In the first preferred embodiment, the rear end 4*a* of the seat 4 is disposed rearward relative to the upper end 19*a* of the outer wall 19. Therefore, as compared with a case where the rear end 4*a* of the seat 4 is disposed forward relative to the upper end 19*a* of the outer wall 19, the distance from the rear end 4*a* of the seat 4 to the opening O1 is shorter. Therefore, a passenger sitting on the rear portion of the seat 4 can easily access the article storage space S1.

In the first preferred embodiment, the second end portion 17 of the washing water passage 15 is connected to the article storage space S1. A hose arranged to supply water into the washing water passage 15 is attached to the second end portion 17 of the washing water passage 15 in a state in which the lid 21 is opened. Then, water supplied from the hose into the washing water passage 15 is supplied into the cooling water passage 14 through the check valve 18. Accordingly, the cooling water passage 14 and the water jacket of the engine 6 are washed. Thus, the second end portion 17 of the washing water passage 15 is connected to the article storage space S1, so that as compared with the case where the second end portion 17 of the washing water passage 15 is disposed below the seat 4, a user of the personal watercraft 1 can easily attach the hose to the second end portion 17 of the washing water passage 15.

In the first preferred embodiment, the article storage space S1 has a U-shaped horizontal sectional shape along the rear portion 31 of the inner wall 20 and the pair of side portions 32 of the inner wall 20. Therefore, a portion of the article storage space S1 is disposed on the lateral side of the inner wall 20. Therefore, as compared with the case where the article storage space S1 is disposed at only the rear of the inner wall 20, the capacity of the article storage space S1 increases. Therefore, a passenger can store a larger number of articles in the article storage space S1.

Second Preferred Embodiment

Figure 10:
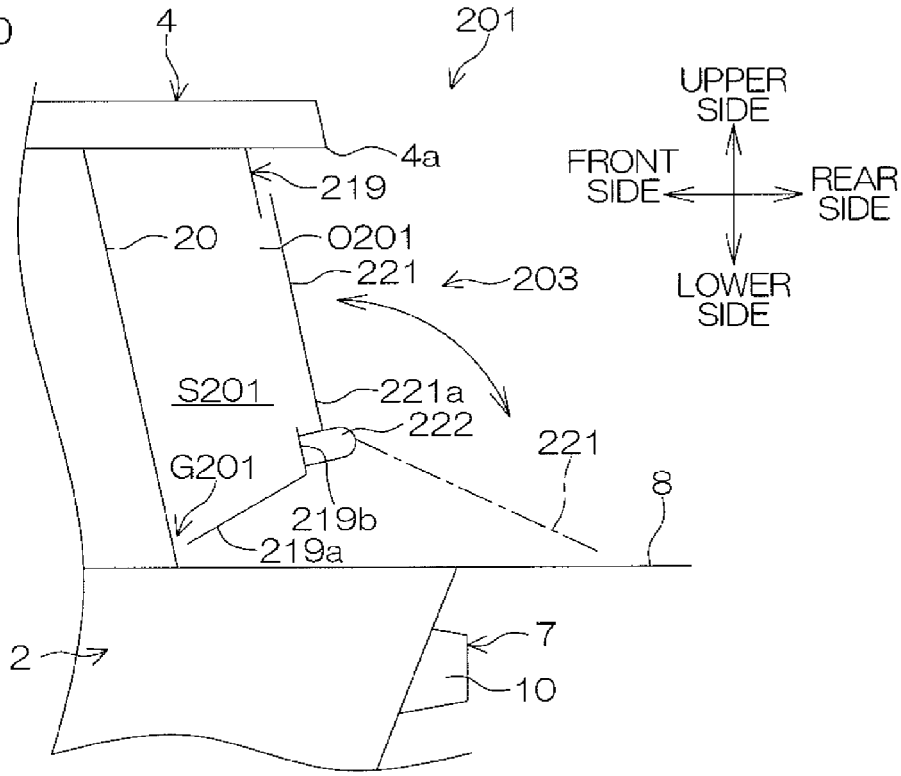
FIG. 10 is a schematic view of a personal watercraft according to a second preferred embodiment of the present invention.

FIG. 10 is a schematic view of a personal watercraft 201 according to a second preferred embodiment of the present invention. In FIG. 10, a state in which a lid 221 is at a closed position is shown by a solid line, and a state in which the lid 221 is at an opened position is shown by alternate long and short dashed lines. In FIG. 10, component portions that are equivalent to respective portions shown in FIGS. 1 to 9 are provided with the same reference symbols as in FIG. 1, etc., and description thereof shall be omitted.

The personal watercraft 201 according to the second preferred embodiment of the present invention has an arrangement similar to that of the personal watercraft 1 according to the first preferred embodiment of the present invention. Therefore, hereinafter, an arrangement different from that of the personal watercraft 1 according to the first preferred embodiment of the present invention will be mainly described.

The personal watercraft 201 includes a deck 203 disposed above the hull 2. The deck 203 includes an outer wall 219 and an inner wall 20. The outer wall 219 is disposed between the rear end 4*a* of the seat 4 and the platform 8. The outer wall 219 preferably has an L-shaped vertical sectional shape. The outer wall 219 includes a bottom portion 219*a* extending rearward from the inner wall 20, and a rear portion 219*b* extending upward from the rear end of the bottom portion 219*a*. The rear end 4*a* of the seat 4 is disposed rearward relative to the upper end of the outer wall 219 (upper end of the rear portion 219*b*). The outer wall 219 and the inner wall 20 define an article storage space S201 positioned between the outer wall 219 and the inner wall 20.

The outer wall 219 defines an opening O201 accessible to the article storage space S201. The opening O201 penetrates through the outer wall 219 in the front-rear direction. The outer wall 219 includes a lid 221 arranged to open and close the opening O201. The deck 203 further includes a hinge 222 which joins the lid 221 and the deck 203. The hinge 222 is provided on the lower portion 221*a* of the lid 221. The lid 221 is rotatable around the hinge 222 between a closed position at which the lid 221 closes the opening O201 and an opened position at which the lid 221 opens the opening O201. The hinge 222 is disposed at the rear of the article storage space S201, and projects rearward. The hinge 222 is arranged to be used as a grip which is gripped during movement from a position in water behind the platform 8 to a position on the platform 8.

The lower end of the outer wall 219 (front end of the bottom portion 219*a*) is disposed along the inner wall 20. The lower end of the outer wall 219 and the inner wall 20 are opposed to each other at a distance in the front-rear direction. The outer wall 219 and the inner wall 20 define a gap G201 positioned between the lower end of the outer wall 219 and the inner wall 20. This gap G201 is communicated with the article storage space S201. Water that entered the article storage space S201 is drained to the outside of the article storage space S201 through the gap G201. Accordingly, retention of water in the article storage space S201 can be reduced.

Third Preferred Embodiment

Figure 11:
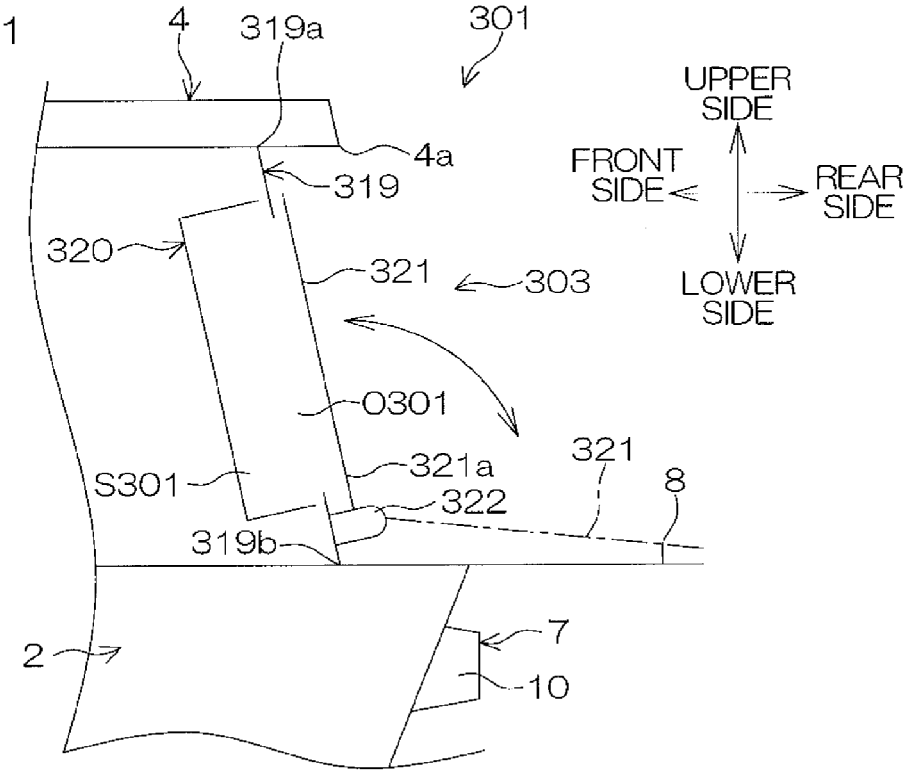
FIG. 11 is a schematic view of a personal watercraft according to a third preferred embodiment of the present invention.

FIG. 11 is a schematic view of a personal watercraft 301 according to a third preferred embodiment of the present invention. In FIG. 11, a state in which a lid 321 is at a closed position is shown by a solid line, and a state in which the lid 321 is at an opened position is shown by alternate long and short dashed lines. In FIG. 11, component portions that are equivalent to respective portions shown in FIGS. 1 to 10 are provided with the same reference symbols as in FIG. 1, etc., and description thereof shall be omitted.

The personal watercraft 301 according to the third preferred embodiment of the present invention has an arrangement similar to that of the personal watercraft 1 according to the first preferred embodiment of the present invention. Therefore, hereinafter, an arrangement different from that of the personal watercraft 1 according to the first preferred embodiment of the present invention will be mainly described.

The personal watercraft 301 includes a deck 303 disposed above the hull 2. The deck 303 includes an outer wall 319 and an inner wall 320. The outer wall 319 is disposed between the rear end 4*a* of the seat 4 and the platform 8. The outer wall 319 is inclined such that the upper end 319*a* of the outer wall 319 is positioned forward relative to the lower end 319*b* of the outer wall 319. The rear end 4*a* of the seat 4 is disposed rearward relative to the upper end 319*a* of the outer wall 319. The inner wall 320 is disposed forward relative to the outer wall 319. The inner wall 320 is disposed such that at least a portion of the outer wall 319 and the inner wall 320 overlap each other from a rearward view. The outer wall 319 and the platform 8 are preferably integral with each other. The outer wall 319 and the platform 8 are not limited to being integral with each other, and may be separate from each other.

The inner wall 320 preferably has a C-shaped vertical sectional shape opened rearward. The inner wall 320 is joined to the outer wall 319. The outer all 319 and the inner wall 320 define an article storage space S301. The outer wall 319 defines an opening O301 accessible to the article storage space S301. The opening O301 penetrates through the outer wall 319 in the front-rear direction. The opening O301 is disposed at the rear of the article storage space S301.

The outer wall 319 includes a lid 321 arranged to open and close the opening O301. The deck 303 further includes a hinge 322 which joins the lid 321 and the deck 303. The hinge 322 is provided on the lower portion 321*a* of the lid 321. The lid 321 is rotatable around the hinge 322 between a closed position at which the lid 321 closes the opening O301 and an opened position at which the lid 321 opens the opening O301. The hinge 322 is disposed rearward relative to the article storage space S301, and projects rearward. The hinge 322 is arranged to be used as a grip which is gripped during movement from a position in water behind the platform 8 to a position on the platform 8.

Fourth Preferred Embodiment

Figure 12:
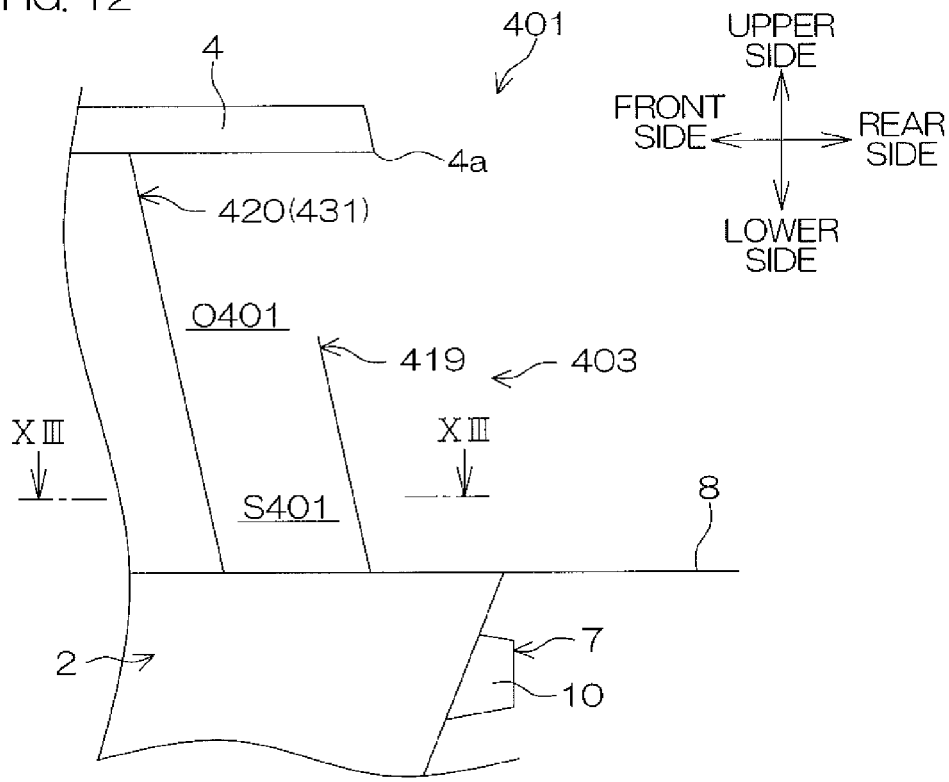
FIG. 12 is a schematic view of a personal watercraft according to a fourth preferred embodiment of the present invention.
Figure 13:
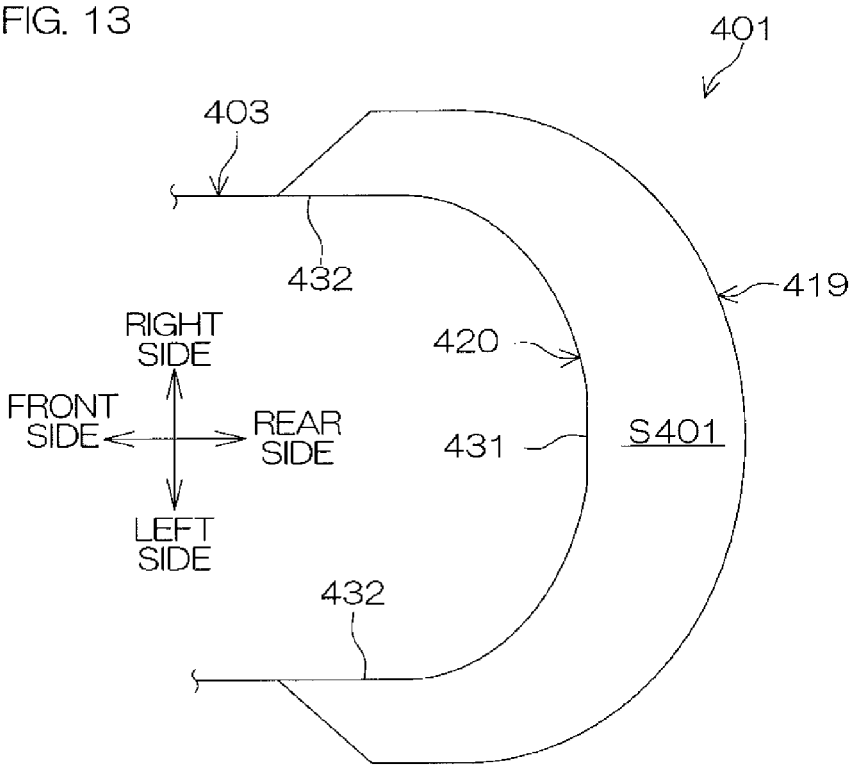
FIG. 13 is a schematic view of the rear portion of the personal watercraft cut along a horizontal plane along line XIII-XIII in FIG. 12.

FIG. 12 is a schematic view of a personal watercraft 401 according to a fourth preferred embodiment of the present invention. FIG. 13 is a schematic view of a rear portion of the personal watercraft 401 cut along a horizontal plane along line XIII-XIII in FIG. 12. In FIG. 12 and FIG. 13, component portions that are equivalent to respective portions shown in FIGS. 1 to 11 are provided with the same reference symbols as in FIG. 1, etc., and description thereof shall be omitted. Hereinafter, FIG. 12 and FIG. 13 will be referred to as is appropriate.

The personal watercraft 401 according to the fourth preferred embodiment of the present invention has an arrangement similar to that of the personal watercraft 1 according to the first preferred embodiment of the present invention. Therefore, hereinafter, an arrangement different from that of the personal watercraft 1 according to the first preferred embodiment of the present invention will be mainly described.

As shown in FIG. 12, the personal watercraft 401 includes a deck 403 disposed above the hull 2, and a seat 4 supported on the deck 403. The deck 403 includes the platform 8, a seat support portion 420 which supports the seat 4, and a cover 419 which covers the seat support portion 420 at a height between the rear end 4*a* of the seat 4 and the platform 8. The seat support portion 420 and the cover 419 extend upward from the platform 8. The upper end of the cover 419 is disposed lower than the upper end of the seat support portion 420. The upper end of the cover 419 is opposed to the seat support portion 420 at a distance in the front-rear direction.

As shown in FIG. 12, the seat support portion 420 and the cover 419 define an article storage space S401 positioned between the seat support portion 420 and the cover 419. The deck 403 defines an opening O401 accessible to the article storage space S401. The opening O401 is disposed between the upper end of the cover 419 and the seat support portion 420. Therefore, the opening O401 is disposed above the article storage space S401. The article storage space S401 is disposed rearward relative to the engine 6 (refer to FIG. 1). Further, the article storage space S401 is disposed at a height between the rear end 4*a* of the seat 4 and the platform 8.

As shown in FIG. 13, the seat support portion 420 includes a rear portion 431 and a pair of right and left side portions 432 connected to the rear portion 431. The pair of side portions 432 extend forward from the right end portion and the left end portion of the rear portion 431. The seat support portion 420 has a U shape in a horizontal cross section. The cover 419 covers the rear portion 431 and the pair of side portions 432. Therefore, the article storage space S401 has a U-shaped horizontal sectional shape along the rear portion 431 and the pair of side portions 432. Accordingly, the capacity of the article storage space S401 is increased.

Fifth Preferred Embodiment

Figure 14:
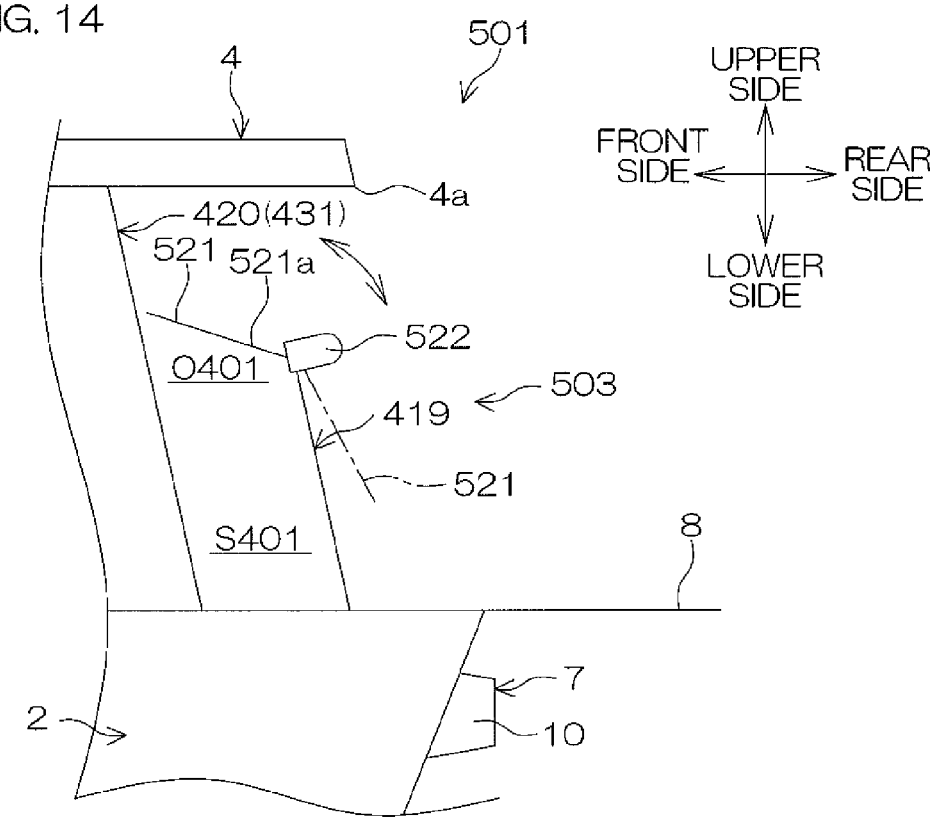
FIG. 14 is a schematic view of a personal watercraft according to a fifth preferred embodiment of the present invention.

FIG. 14 is a schematic view of a personal watercraft 501 according to a fifth preferred embodiment of the present invention. In FIG. 14, a state in which a lid 521 is at a closed position is shown by a solid line, and a state in which the lid 521 is at an opened position is shown by alternate long and short dashed lines. In FIG. 14, component portions that are equivalent to respective portions shown in FIGS. 1 to 13 are provided with the same reference symbols as in FIG. 1, etc., and description thereof shall be omitted.

The personal watercraft 501 according to the fifth preferred embodiment of the present invention has an arrangement similar to that of the personal watercraft 401 according to the fourth preferred embodiment of the present invention. Therefore, hereinafter, an arrangement different from that of the personal watercraft 401 according to the fourth preferred embodiment of the present invention will be mainly described.

The personal watercraft 501 includes a deck 503 disposed above the hull 2. The deck 503 includes a platform 8, a seat support portion 420, and a cover 419. Further, the deck 503 includes a lid 521 covering the opening O401, and a hinge 522 which joins the lid 521 and the deck 503. The hinge 522 is provided on a lower portion 521*a* of the lid 521. The lid 521 is arranged rotatably around the hinge 522 between a closed position at which the lid 521 closes the opening O401 and an opened position at which the lid 521 opens the opening O401. The hinge 522 projects rearward. The hinge 522 is arranged to be used as a grip which is gripped during movement from a position in water behind the platform 8 to a position on the platform 31.

Sixth Preferred Embodiment

Figure 15:
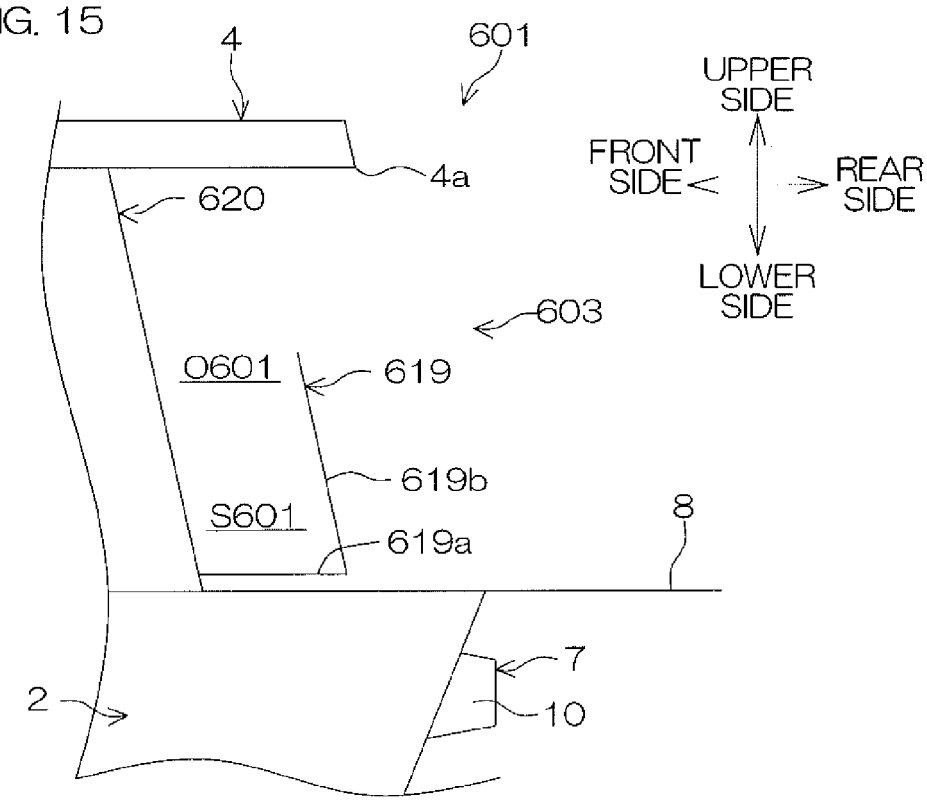
FIG. 15 is a schematic view of a personal watercraft according to a sixth preferred embodiment of the present invention.

FIG. 15 is a schematic view of a personal watercraft 601 according to a sixth preferred embodiment of the present invention. In FIG. 15, component portions that are equivalent to respective portions shown in FIGS. 1 to 14 are provided with the same reference symbols as in FIG. 1, etc., and description thereof shall be omitted.

The personal watercraft 601 according to the sixth preferred embodiment of the present invention has an arrangement similar to that of the personal watercraft 1 according to the first preferred embodiment of the present invention. Therefore, hereinafter, an arrangement different from that of the personal watercraft 1 according to the first preferred embodiment of the present invention will be mainly described.

The personal watercraft 601 includes a deck 603 disposed above the hull 2, and a seat 4 supported on the deck 603. The deck 603 includes a platform 8, a seat support portion 620 which supports the seat 4, and a cover 619 which covers the seat support portion 620 from the rear side at a height between the rear end 4*a* of the seat 4 and the platform 8. The seat support portion 620 extends upward from the platform 8. The cover 619 is joined to the seat support portion 620. The cover 619 has an L-shaped vertical sectional shape. The cover 619 includes a bottom portion 619*a* extending rearward from the seat support portion 620 and a rear portion 619*b* extending upward from the rear end of the bottom portion 619*a*. The upper end of the rear portion 619*b* is disposed lower than the upper end of the seat support portion 620. The upper end of the rear portion 619*b* is opposed to the seat support portion 620 at a distance in the front-rear direction.

The seat support portion 620 and the cover 619 define an article storage space S601 positioned between the seat support portion 620 and the cover 619. The deck 603 defines an opening O601 accessible to the article storage space S601. The opening O601 is disposed between the upper end of the rear portion 219*b* and the seat support portion 620. Therefore, the opening O601 is positioned above the article storage space S601. The article storage space S601 is disposed rearward relative to the engine 6 (refer to FIG. 1). Further, the article storage space S601 is disposed at a height between the rear end 4*a* of the seat 4 and the platform 8.

Seventh Preferred Embodiment

Figure 16:
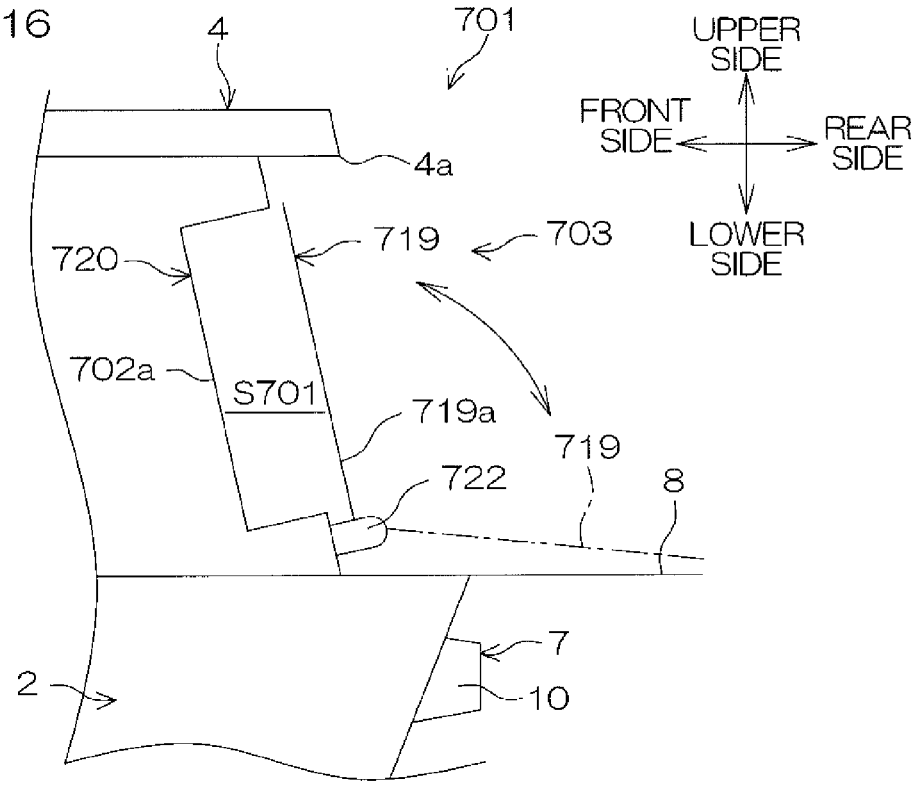
FIG. 16 is a schematic view of a personal watercraft according to a seventh preferred embodiment of the present invention.

FIG. 16 is a schematic view of a personal watercraft 701 according to a seventh preferred embodiment of the present invention. In FIG. 16, a state in which a cover 719 is at a closed position is shown by a solid line, and a state in which the cover 719 is at an opened position is shown by alternate long and short dashed lines. In FIG. 16, component portions that are equivalent to respective portions shown in FIGS. 1 to 15 are provided with the same reference symbols as in FIG. 1, etc., and description thereof shall be omitted.

The personal watercraft 701 according to the seventh preferred embodiment of the present invention has an arrangement similar to that of the personal watercraft 1 according to the first preferred embodiment of the present invention. Therefore, hereinafter, an arrangement different from that of the personal watercraft 1 according to the first preferred embodiment of the present invention will be mainly described.

The personal watercraft 701 includes a deck 703 disposed above the hull 2, and a seat 4 supported on the deck 703. The deck 703 includes the platform 8, a seat support portion 720 which supports the seat 4, and a cover 719 covering the seat support portion 720 from the rear side at a height between the rear end 4*a* of the seat 4 and the platform 8. The seat support portion 720 extends upward from the platform 8. The seat support portion 720 includes a recess portion 720*a*. The recess portion 720*a* is covered by the cover 719. The cover 719 and the recess portion 720*a* define an article storage space S701 positioned between the cover 719 and the recess portion 720*a*.

The deck 703 further includes a hinge 722 which joins the cover 719 and the deck 703. The hinge 722 is provided on a lower portion 719*a* of the cover 719. The cover 719 is arranged rotatably around the hinge 722 between a closed position at which the article storage space S701 is closed and an opened position at which the article storage space S701 is opened. The hinge 722 projects rearward. The hinge 722 is arranged to be used as a grip which is gripped during movement from a position in water behind the platform 8 to a position on the platform 8.

Eighth Preferred Embodiment

Figure 17:
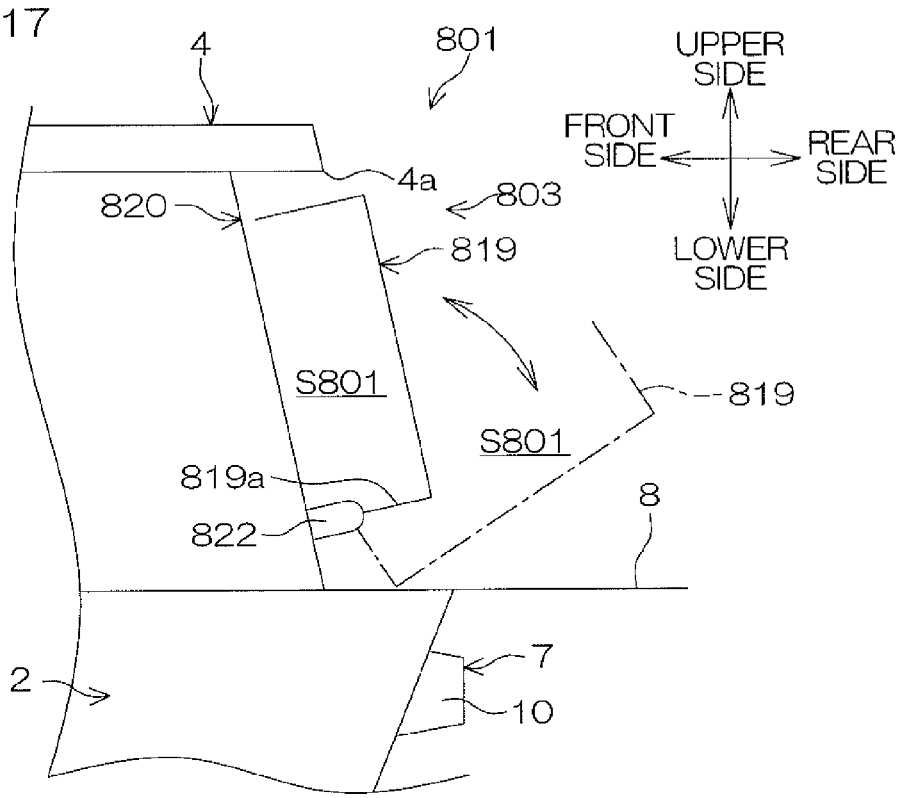
FIG. 17 is a schematic view of a personal watercraft according to an eighth preferred embodiment of the present invention.

FIG. 17 is a schematic view of a personal watercraft 801 according to an eighth preferred embodiment of the present invention. In FIG. 17, a state in which a cover 819 is at a closed position is shown by a solid line, and a state in which the cover 819 is at an opened position is shown by alternate long and short dashed lines. In FIG. 17, component portions that are equivalent to respective portions shown in FIGS. 1 to 16 are provided with the same reference symbols as in FIG. 1, etc., and description thereof shall be omitted.

The personal watercraft 801 according to the eighth preferred embodiment of the present invention has an arrangement similar to that of the personal watercraft 1 according to the first preferred embodiment of the present invention. Therefore, hereinafter, an arrangement different from that of the personal watercraft 1 according to the first preferred embodiment of the present invention will be mainly described.

The personal watercraft 801 includes a deck 803 disposed above the hull 2, and a seat 4 supported on the deck 803. The deck 803 includes the platform 8, a seat support portion 820 which supports the seat 4, and a cover 819 covering the seat support portion 820 from the rear side at a height between the rear end 4*a* of the seat 4 and the platform 8. The seat support portion 820 extends upward from the platform 8. The cover 819 preferably has a C-shaped vertical sectional shape opened forward. The cover 819 defines an article storage space S801.

The deck 803 further includes a hinge 822 which joins the cover 819 and the deck 803. The hinge 822 is provided on a lower portion 819*a* of the cover 819. The cover 819 is arranged rotatably around the hinge 822 between a closed position at which the article storage space S801 is closed and an opened position at which the article storage space S801 is opened. When the cover 819 moves from the closed position to the opened position, the article storage space S801 turns around the hinge 811. Accordingly, the article storage space S801 moves rearward, and the article storage space S801 is opened.

Other Preferred Embodiments

Although the preferred embodiments of the present invention have been described above, the present invention is not limited to the contents of the preferred embodiments described above, and various modifications are possible within the scope of the claims.

For example, in the preferred embodiments described above, a case where a hinge is preferably provided on the lower portion of the lid or cover is described. However, the hinge may be provided on any of the upper portion, the right side portion, and the left side portion of the lid. Therefore, the lid may be arranged to turn up and down around the upper portion of the lid, or may be arranged to turn to the right and left around the right side portion or the left side portion of the lid. The same applies to the cover.

In the preferred embodiments described above, a case where a lid and a cover are preferably joined to the deck by a hinge is described. However, the lid and cover may be joined by a joint member other than the hinge. In detail, the lid and cover may be joined to the deck so as to slide up and down or rightward and leftward between the closed position and the opened position. Further, the lid and cover may be removably joined to the deck.

In the preferred embodiments described above, a case where a gap communicated with the article storage space is provided between either the platform or the inner wall and the lower end of the outer wall is described. However, it is also possible that the space between either the platform or the inner wall and the lower end of the outer wall is closely sealed by a sealing member such as a seal, no gap is provided between either the platform or the inner wall and the lower end of the outer wall.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A personal watercraft comprising:

a hull;

a deck disposed above the hull; and a seat supported on the deck; wherein the deck includes:

a platform disposed at a stern of the personal watercraft, the platform disposed along a horizontal plane at a position lower than a rear end of the seat;

an outer wall disposed between the seat and the platform, the outer wall being inclined such that an upper end of the outer wall is positioned forward relative to a lower end of the outer wall; and an inner wall disposed forward relative to the outer wall, the inner wall being arranged such that at least a portion of the outer wall and the inner wall overlap each other from a rearward view of the personal watercraft; wherein the outer wall defines an opening accessible to an article storage space provided between the outer wall and the inner wall, and a lid is arranged to open and close the opening;

the deck further includes a hinge provided on the lid and arranged to join the lid and the deck such that the lid rotates around the hinge between a closed position at which the lid closes the opening and an opened position at which the lid opens the opening; and the hinge is visible from the rearward view of the personal watercraft in a state in which the lid is at the closed position.

2. The personal watercraft according to claim 1, wherein a concave portion is provided at the lid, the concave portion extending inward from an outer edge of the lid from the rearward view of the personal watercraft; and at least a portion of the hinge is disposed in the concave portion.

3. The personal watercraft according to claim 1, wherein the hinge and the outer wall define a hand insertion space which is positioned between the hinge and the outer wall and accessible from an upper side of the hand insertion space.

4. The personal watercraft according to claim 3, wherein the hinge is arranged to be used as a grip which is gripped by a user during movement of the user from a position behind the platform to a position on the platform.

5. The personal watercraft according to claim 1, wherein the platform and the inner wall are integral with each other; and the outer wall is separate from the platform and the inner wall.

6. The personal watercraft according to claim 5, wherein a gap communicated with the article storage space is provided between either the platform or the inner wall and the lower end of the outer wall.

7. The personal watercraft according to claim 1, wherein the rear end of the seat is disposed rearward relative to the upper end of the outer wall.

8. The personal watercraft according to claim 1, further comprising:

a cooling water passage disposed inside the personal watercraft; and a washing water passage arranged to supply water to the cooling water passage so as to wash the cooling water passage; wherein the washing water passage includes a first end portion connected to the cooling water passage, a second end portion connected to the article storage space, and a check valve arranged such that water flows only in a direction from the second end portion to the first end portion.

9. The personal watercraft according to claim 1, wherein the inner wall includes a rear portion and a pair of right and left side portions connected to the rear portion; and the article storage space has a U-shaped horizontal sectional shape along the rear portion and the pair of right and left side portions.

10. A personal watercraft comprising:

a hull;

a deck disposed above the hull, the deck including a seat support portion; and a seat supported on the seat support portion; wherein the deck includes:

a platform disposed at a stern of the personal watercraft, the platform being disposed along a horizontal plane at a position lower than a rear end of the seat; and a cover covering at least a portion of the seat support portion at a height between the rear end of the seat and the platform from a rear view of the personal watercraft; wherein the deck defines an article storage space provided between the seat support portion and the cover, and an opening accessible to the article storage space;

the deck further includes a lid covering the opening, and a hinge provided on the lid and arranged to join the lid and the deck such that the lid rotates around the hinge between a closed position at which the lid closes the opening and an opened position at which the lid opens the opening;

the hinge is visible from the rear view of the personal watercraft in a state in which the lid is at the closed position;

a concave portion is provided at the lid, the concave portion extending inward from an outer edge of the lid from the rearward view of the personal watercraft; and at least a portion of the hinge is disposed in the concave portion.

11. A personal watercraft comprising:

a hull;

a deck disposed above the hull; and a seat supported on the deck; wherein the deck includes:

a platform disposed at a stern of the personal watercraft, the platform disposed along a horizontal plane at a position lower than a rear end of the seat;

an outer wall disposed between the seat and the platform, the outer wall being inclined such that an upper end of the outer wall is positioned forward relative to a lower end of the outer wall; and an inner wall disposed forward relative to the outer wall, the inner wall being arranged such that at least a portion of the outer wall and the inner wall overlap each other from a rearward view of the personal watercraft; wherein the outer wall defines an opening accessible to an article storage space provided between the outer wall and the inner wall, and a lid is arranged to open and close the opening;

a gap communicated with the article storage space is provided between either the platform or the inner wall and the lower end of the outer wall;

at least a portion of the gap is disposed at a height equal to a bottom surface of the article storage space; and the gap is visible from the rearward view of the personal watercraft.

* * * * *